US007429187B1

(12) United States Patent
Gurak

(10) Patent No.: US 7,429,187 B1
(45) Date of Patent: Sep. 30, 2008

(54) CABLE STRAIN-RELIEVING MECHANISM

(75) Inventor: Ronald J. Gurak, Crystal Lake, IL (US)

(73) Assignee: Snap-on Incorporated, Kenosha, WI (US)

( * ) Notice: Subject to any disclaimer, the term of this patent is extended or adjusted under 35 U.S.C. 154(b) by 0 days.

(21) Appl. No.: 11/810,162

(22) Filed: Jun. 5, 2007

(51) Int. Cl.
*H01R 13/58* (2006.01)

(52) U.S. Cl. ..... 439/449

(58) Field of Classification Search ..... 439/449, 439/607–610, 470, 680, 327–328, 905, 445, 439/447, 451, 374–375
See application file for complete search history.

(56) References Cited

U.S. PATENT DOCUMENTS 5,522,735 A * 6/1996 Wright ..... 439/540.1
6,206,714 B1 * 3/2001 Bernardini ..... 439/335
6,220,888 B1 * 4/2001 Correa ..... 439/445
7,252,536 B2 * 8/2007 Lazaro et al. ..... 439/470
2003/0139087 A1 * 7/2003 Sprunger ..... 439/449

* cited by examiner

*Primary Examiner*—J. F. Duverne
(74) *Attorney, Agent, or Firm*—McDonnell, Boehnen, Hulbert & Berghoff

(57) ABSTRACT

A strain-relieving apparatus for a cable, comprising a housing and a shroud. A cable is inserted into a port on a device, such as an electronic device. The shroud is permanently affixed to the cable, and attaches to and rotates within the housing to lock the shroud into the housing. The shroud may also unlock from the housing by rotating the shroud within the housing, until tabs located on the shroud are aligned with recesses in the housing, allowing for the shroud to be removed from the housing.

17 Claims, 7 Drawing Sheets

CABLE STRAIN-RELIEVING MECHANISM

FIELD

The present application relates generally to strain-relieving mechanisms. More particularly, the present application relates to cable strain-relieving mechanisms.

BACKGROUND

The inadvertent removal of a cable from a port is a common problem. Many cables, such as Universal Serial Bus cables, are removably inserted into ports located on devices such as computers, or hand-held diagnostic equipment. Even a minimal disruption, such as lifting the computer, or stepping on the cable, may detach the cable from its inserted position in the port of the device.

There is a need for an easy to use apparatus that will prevent a cable from inadvertently becoming detached from the port on a device.

SUMMARY

The present application discloses a strain-relieving apparatus for a cable. The apparatus comprises a housing and a shroud. The housing is permanently affixed to a device, such as hand-held diagnostic equipment, and surrounds the perimeter of a port on the device. The cable is inserted into the port on the device. The shroud is permanently affixed to the cable, and tabs on the shroud are inserted through recesses in the housing, and into a channel. The tabs may then move along the channel, rotating the shroud 90 degrees clockwise. Once the shroud has been rotated the full 90 degrees, a ridge in the channel catches a groove in the tab, effectively locking the shroud to the housing.

To unlock the shroud from the housing and remove the cable from the port, the shroud is then rotated 90 degrees in the counter-clockwise direction, until the tabs are aligned with the recesses in the housing, allowing for the tabs to be pulled out of the housing.

DETAILED DESCRIPTION

Figure 1:
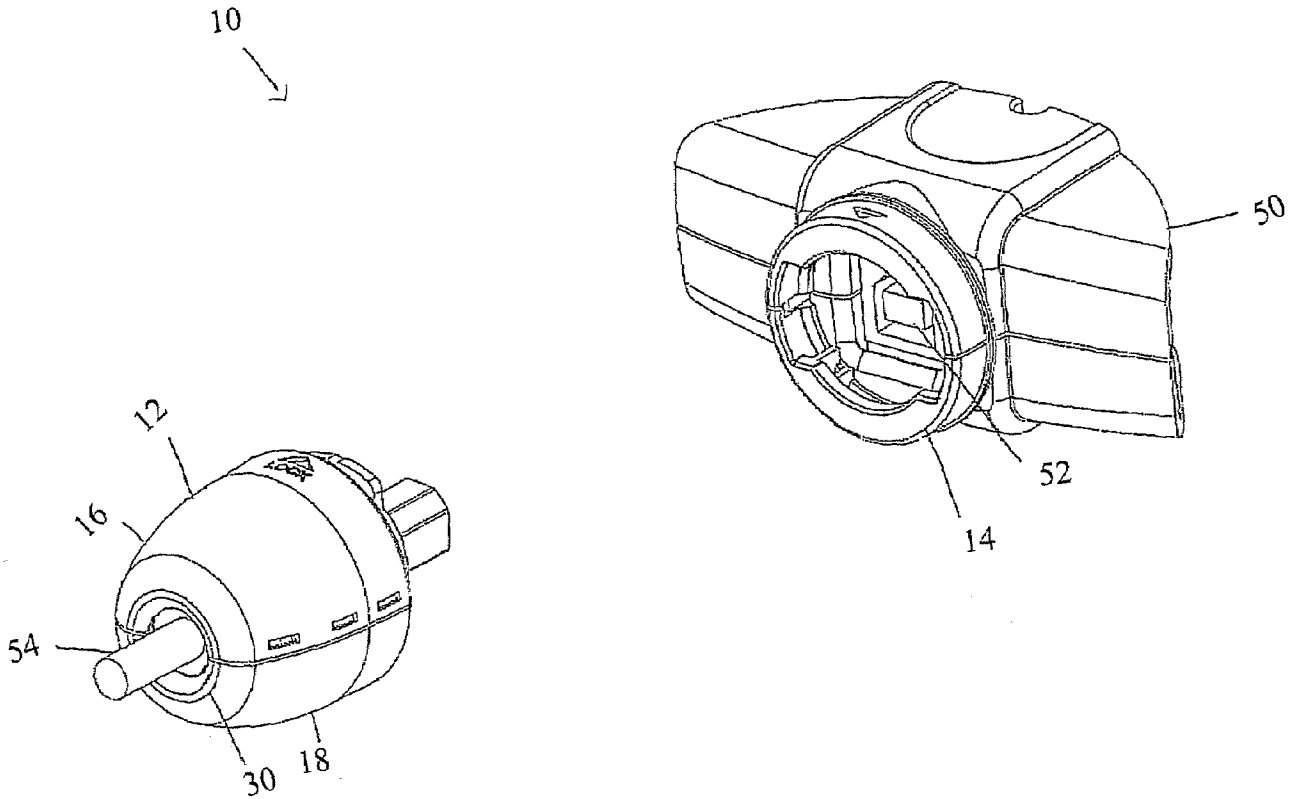
FIG. 1 is a perspective view of the strain-relieving apparatus.

FIG. 1 illustrates a perspective view of the strain-relieving apparatus. The apparatus is shown generally at 10, and includes a shroud 12 and a housing 14. Shroud 12 comprises a first section 16 and a second section 18. The material for both shroud 12 and housing 14 is preferably a durable, wear-resistant material such as a metal or strong plastic. A cable 54 is enclosed by first section 16 and second section 18, as shown in FIG. 1.

In an exemplary embodiment, housing 14 is permanently affixed to a device 50. Housing 14 may be a part that is molded onto device 50 during the manufacturing process of device 50. Device 50 may be an electronic device, such as any portable, hand-held diagnostic equipment or a computer. Device 50 includes a port 52. Housing 14 surrounds the perimeter of port 52, and is also permanently affixed to device 50, as made during the manufacturing process.

Figure 2:
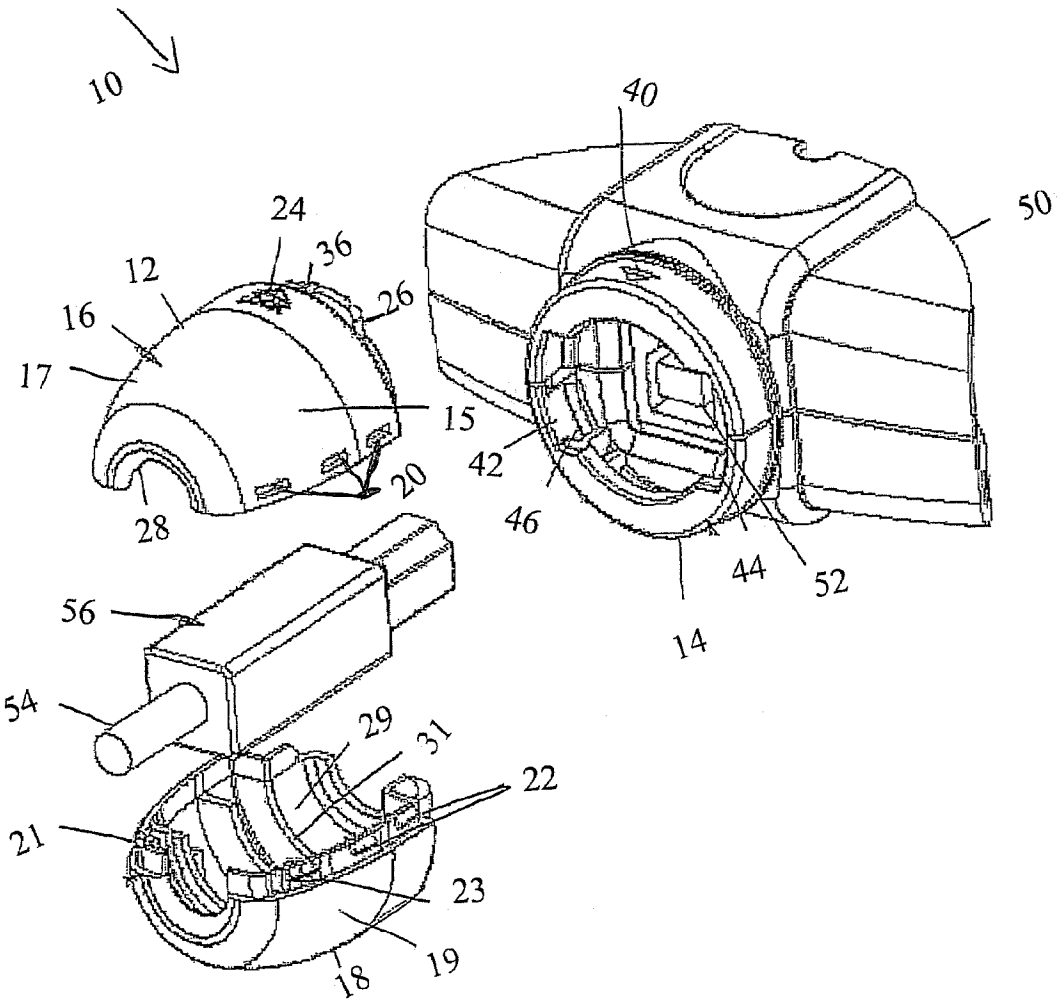
FIG. 2 is an exploded view of a preferred embodiment according to the present invention.
Figure 5:
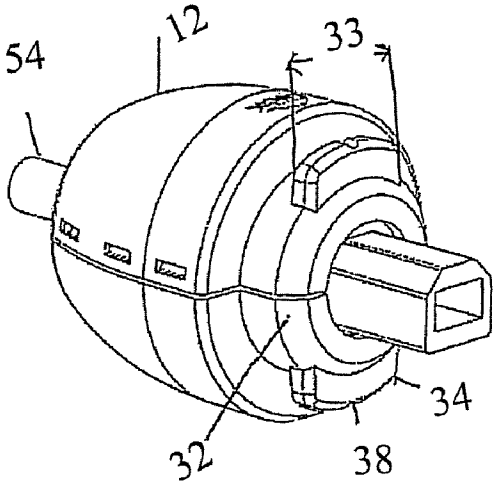
FIG. 5 is a perspective view of the back of the shroud.

FIG. 2 illustrates an exploded view of an embodiment of apparatus 10. Cable 54 is positioned through a first C-channel 28 and a second C-channel 29 of first section 16 and second section 18, respectively, of shroud 12. C-channel 28 of first section 16 is similar to C-channel 29 of second section 18. Both C-channel 28 and C-channel 29 are positioned close enough to cable 54 to allow for minimal radial movement. Rectangular extrusions 31 are positioned within C-channel 29 to support cable 54. First section 16 may be mechanically attached to second section 18. When first section 16 and second section 18 of shroud 12 are attached to each other, a first wall 30 and a second wall 32 are formed, as shown in FIG. 1 and FIG. 5, respectively.

To attach first section 16 to second section 18, first section 16 comprises a plurality of holes 20, and second section 18 comprises a corresponding plurality of grips 22. Each grip of the plurality of grips 22 may be smaller than each corresponding hole of the plurality of holes 20, so that each grip is insertable into each hole. In the exemplary embodiment of FIG. 2, once the plurality of grips 22 are inserted into the plurality of holes 20, a ledge 23 on each of the plurality of grips prevents the grip from sliding back through the hole, effectively attaching first section 16 to second section 18.

First section 16 has a first side 15 and a second side 17. As shown in FIG. 2, first side 15 has three holes. Second side 17 also comprises three holes. Alternatively, first side 15 and second side 17 may each comprise a quantity of holes greater than or less than three holes.

Similarly, second section 18 has a first side 19 and a second side 21. As shown in FIG. 2, the first side 19 has three grips. Second side 21 also has three grips (not shown). Alternatively, first side 19 and second side 21 may each have a quantity of grips greater than or less than three grips.

As an alternative, first side 15 may comprise grips and second side 17 may comprise holes, and first side 19 may comprise corresponding holes and second side 21 may comprise corresponding grips.

As another alternative, neither first side 15 nor second side 17 of first section 16 may comprise holes, and neither first side 19 nor second side 21 of second section 18 may comprise grips. In this alternative, first section 16 may be attached to second section 18 using another method, such as attaching the first section and second section with an adhesive.

First section 16 and second section 18 of shroud 12 may be assembled onto cable 54 during the manufacturing stage. Shroud 12 may be designed to be permanently affixed to cable 54. Alternatively, shroud 12 may be designed to be removable from cable 54.

Cable 54 may comprise a raised portion 56. Raised portion 56 may be located between first section 16 and second section 18 when these sections are attached. More specifically, raised portion 56 may be located between first wall 30 and second wall 32 so as to prevent shroud 12 from moving axially along cable 54.

Cable 54 may comprise any of a variety of cables that connect to port 52. For example, cable 54 may comprise a cable in accordance with a Universal Serial Bus (USB) specification, such as the USB Specification, Revision 2.0, dated Apr. 27, 2000. In this regard, cable 54 may be referred to as a USB cable. As another example, cable 54 may be a cable in accordance with the 1.01 Revision to the USB 2.0 specification, which provides for a USB cable that is adapted for use on portable devices.

As another example, cable 54 may comprise a cable in accordance with the IEEE 1394 standard, the Firewire 400 standard, or the Firewire 800 standard. As yet another example, cable 54 may comprise a fiber optic cable. Other examples of cable 54 are also possible.

In addition to the aforementioned items, first section 16 also includes a first arrow 24, a first tab 26. Second section 18 includes a second tab 34. First tab 26 includes a first groove 36, as shown in FIG. 2. Second tab 34 includes a second groove 38, as shown in FIG. 5.

Housing 14 includes a second arrow 40, a first recession 42, a second recession 44, a channel 46, and a ridge 48.

First arrow 24 and second arrow 40 may be etched into first section 16 and housing 14, respectively. Alternatively, first arrow 24 and second arrow 40 may be painted, drawn, or molded onto first section 16 and housing 14, respectively. First tab 26 and second tab 34 are affixed to first section 16 and second section 18, as shown in FIG. 5.

In operation, to prevent the inadvertent removal of cable 54 from port 52, cable 54 is inserted into port 52, and first tab 26 and second tab 34 of shroud 12 are aligned with first recession 42 and second recession 44 of housing 14, respectively. First tab 26 and second tab 34 may comprise a width 33, as shown in FIG. 5. As an example, width 33 may span 10 degrees. Alternatively, width 33 may comprise a width that spans greater than or less than 10 degrees. First recession 42 and second recession 44 may cover a width greater than width 33 to allow for insertion of tab 26 and second tab 34.

Figure 3:
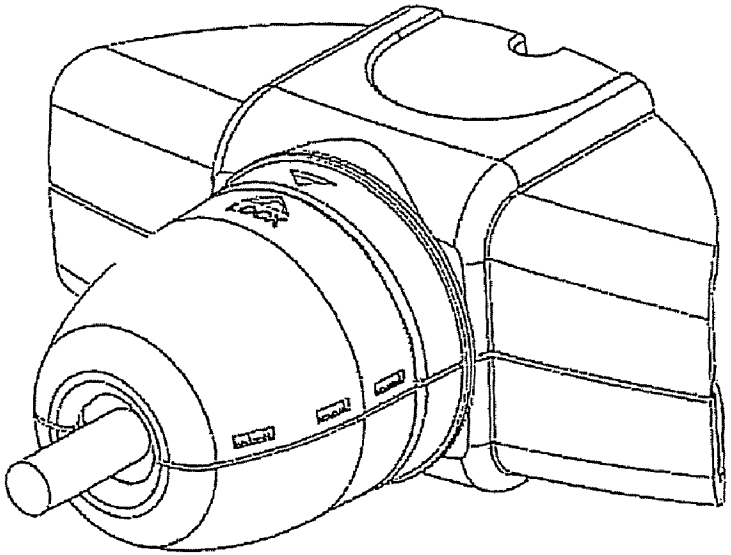
FIG. 3 is a perspective view of the strain-relieving apparatus in the locked position.
Figure 4:
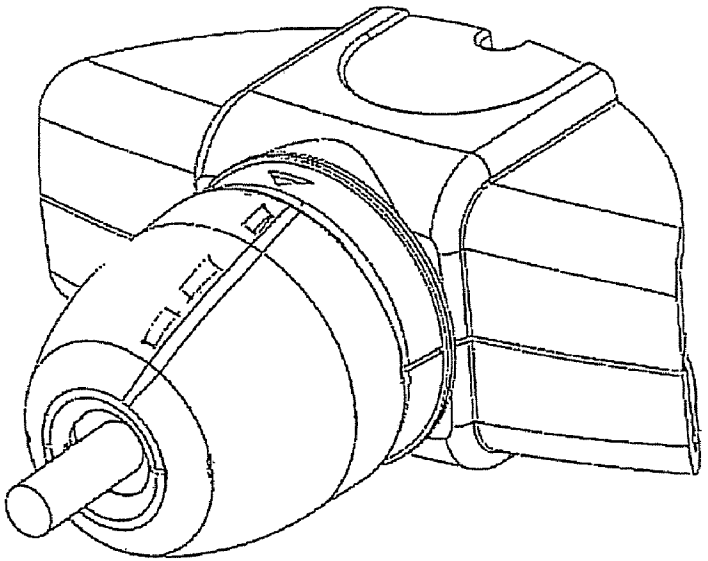
FIG. 4 is a perspective view of the strain-relieving apparatus in the unlocked position.
Figure 6:
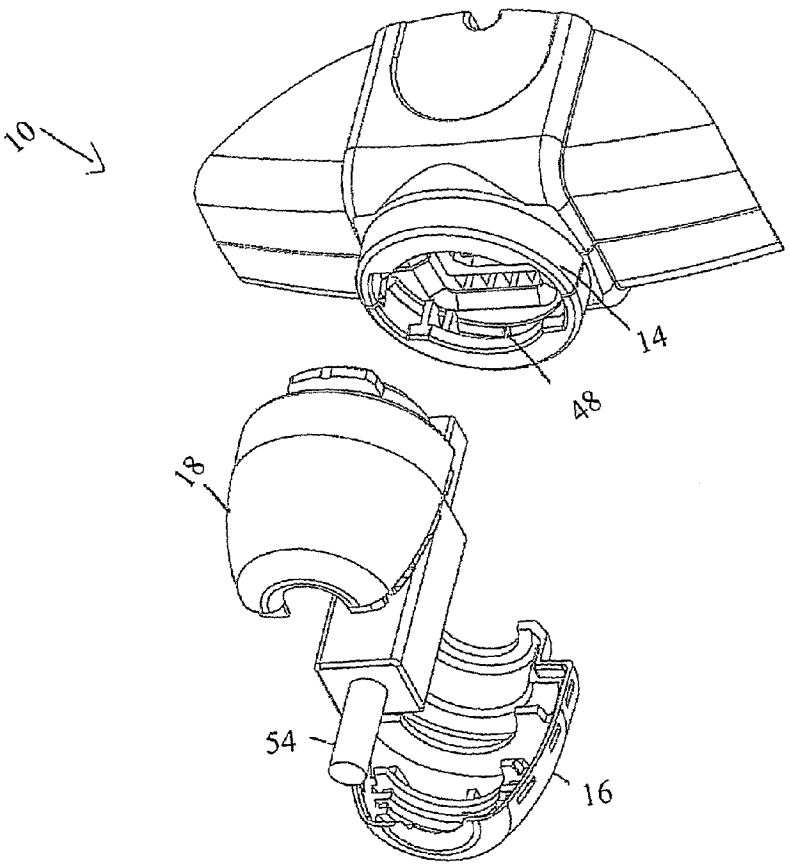
FIG. 6 is a perspective view of the housin.

First tab 26 and second tab 34 are inserted into first recession 42 and second recession 44, and are pushed through each recession until each tab is inserted into channel 46. Channel 46 provides a path for first tab 26 and second tab 34 to travel from (i) a shroud unlocked position to a shroud locked position or (ii) a shroud locked position to a shroud unlocked position. Channel 46 may comprise a path that spans the entire 360 degrees of housing 14. Once both first tab 26 and second tab 34 are fitted within channel 46, shroud 12 is rotated approximately 90 degrees clockwise. Approximately may be defined as within a range of 1 to 2 degrees. First groove 36 on first tab 26 then makes mechanical contact with corresponding ridge 48, the ridge being shown in FIG. 6. As an alternative, ridge 48 may be located 180 degrees from where it is shown in FIG. 6. Once ridge 48 has entered into first groove 36, shroud 12 is effectively locked into housing 14, as shown in FIG. 3. Ridge 48 may be located at the point along the channel that is designated with second arrow 40 on housing 14. Correspondingly, the location of first tab 26 on shroud 12 may be designated with first arrow 24. An identical ridge to ridge 48 may also be located approximately 180 degrees on the housing from ridge 48. Alignment of first arrow 24 and second arrow 40 indicate that first groove 36 on first tab 26 has made mechanical contact with ridge 48.

Alternatively, the apparatus may be designed so that shroud 12 may be rotated approximately 90 degrees counter-clockwise to lock shroud 12 into housing 14. The apparatus may also be designed so that shroud 12 may be rotated a number of degrees that are greater than or less than 90 degrees to lock shroud 12 into housing 14. When in the locked position, cable 54 can withstand in excess of a 50 lb. pull force without disconnecting from port 52.

In the embodiment in which the shroud is rotated clockwise to lock shroud 12 into housing 14, to unlock shroud 12 from housing 14, shroud 12 is rotated 90 degrees in the counter-clockwise direction, until first tab 26 and second tab 34 are aligned with first recession 42 and second recession 44, respectively. When shroud 12 is rotated, housing 14 flexes slightly, allowing for the dislocation of first groove 36 from ridge 48. Shroud 12 is then removed from housing 14.

In the embodiment in which shroud 12 is rotated counter-clockwise to lock shroud 12 into housing 14, to unlock shroud 12, the apparatus may be designed so that shroud 12 may be rotated approximately 90 degrees clockwise from housing 14. The apparatus may also be designed so that shroud 12 may be rotated a number of degrees that are greater than or less than 90 degrees.

Figure 7:
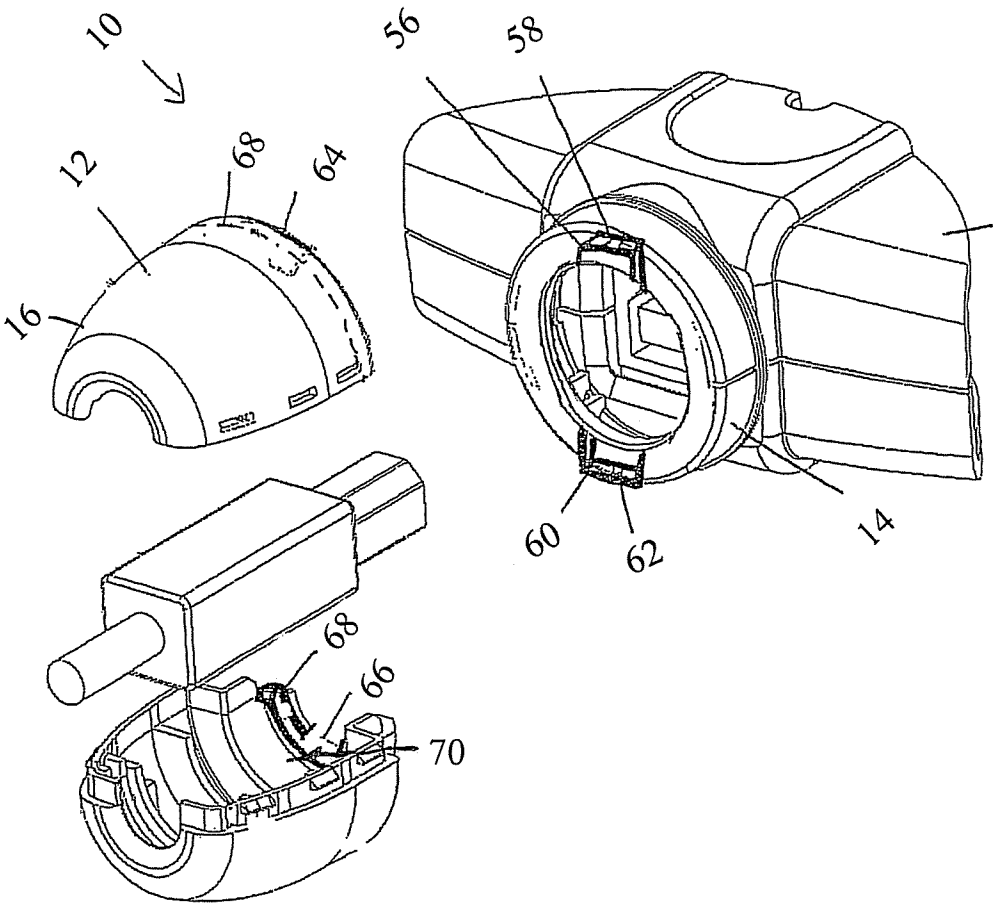
FIG. 7 is a perspective view of an alternative embodiment of the housing.

As an alternative embodiment, as shown in FIG. 7, housing 14 may comprise a first tab 56, a first groove 58, a second tab 60, and a second groove 62. Shroud 12 may comprise a first recession 64, a second recession 66, a channel 68, and a ridge 70. In this embodiment, first recession 64 and second recession 66 are pushed into first tab 56 and second tab 60, to insert first tab 56 and second tab 60 into the respective recession. First tab 56 and second tab 60 then slide along channel 68 until ridge 70 enters first groove 58, effectively locking housing 14 into shroud 12. To unlock housing 14 from shroud 12, shroud 12 is rotated, allowing for the dislocation of first groove 58 from ridge 70. Shroud 12 is then removed from housing 14. Channel 68 and first recession 64 are shown to be located within first section 16 of shroud 12 with dotted lines.

For purposes of this specification, substantially similar is defined as within a range of 1 to 2 degrees.

Although the apparatus has been described in detail with particular reference to a preferred embodiment, other embodiments can achieve the same results. Variations and modifications of the present invention will be obvious to those skilled in the art and it is intended to cover in the appended claims all such modifications and equivalents. The entire disclosures of all references, applications, patents, and publications cited above, are hereby incorporated by reference.

The invention claimed is:

1. An apparatus installable on a cable and rotatable between an unlocked position and a locked position, comprising:

a housing having a channel with a ridge at a point along the channel, wherein the housing is integral with a device and encircles a port on the device; and a shroud, wherein the shroud is affixed to the cable;

wherein the cable is inserted into the port, and wherein the shroud is removably attached to the housing, and is lockable to the housing by moving the shroud within the channel until the ridge stops the movement of the shroud, effectively locking the shroud into the housing.

2. The apparatus of claim 1, wherein a plurality of tabs on the shroud are aligned with a plurality of recessions on the housing to insert the shroud into the housing.

3. The apparatus of claim 2, wherein the plurality of tabs insert into the channel allowing the plurality of tabs to move through the channel.

4. The apparatus of claim 3, wherein the shroud is rotated a first number degrees to a locked position, the locked position being formed when a groove on the tabs of the shroud is stopped by the ridge.

5. The apparatus of claim 4, wherein the shroud is rotated a second number of degrees from the locked position to unlock the shroud from the housing.

6. The apparatus of claim 5, wherein the first number of degrees is substantially similar to the second number of degrees.

7. The apparatus of claim 4, wherein the first number of degrees is within a range spanning 60 to 120 degrees.

8. The apparatus of claim 7, wherein the range is approximately 90 degrees.

9. The device of claim 1, wherein the shroud cannot move axially along the cable.

10. The device of claim 1, wherein the shroud is affixed to the cable by insertion of the cable between a first section and a second section, and subsequently mechanically connecting the first section to the second section.

11. A method for relieving strain on a cable, comprising:

attaching a cable to a port; wherein the port is integral with a device and is accessible through a housing on the device;

attaching a shroud to the cable;

inserting a plurality tabs on the shroud into a channel within the housing;

rotating the shroud, wherein the tabs move along the channel within the housing;

locking the shroud into a locked position within the housing, wherein a ridge within the channel enters a groove on one of the plurality of tabs.

12. The method of claim 8, further comprising unlocking the shroud from the housing by dislocating the groove from the ridge and rotating the shroud around the housing to a point where the shroud may be removed from the housing.

13. The method of claim 9, wherein the point where the shroud may be removed from the housing is designated by a recession in the housing, and further comprises aligning the tab with the recession in the housing to remove the tab from the recession.

14. An apparatus installable on a cable and rotatable between an unlocked position and a locked position, comprising:

a housing having a plurality of recessions, a channel that spans a length between the recessions, and a ridge at a point along the channel; and a shroud, wherein the shroud is affixed to the cable and includes a first section that attaches to a second section to contain the cable within the shroud, the first section and second section each comprising a tab, at least one of the tabs further comprises a groove;

wherein the shroud is removably attached to the housing by insertion of the tabs of the shroud through the recessions of the housing and into the channel of the housing, and is rotatable by moving the tabs through the channels until the groove on at least one of the tabs is in mechanical connection with the ridge of the housing.

15. An apparatus as in claim 14, wherein the point along the channel is approximately 90 degrees from either of the recessions.

16. A shroud for securing a cable to a port of a device, the shroud comprising:

a first section comprising a first tab, a first c-channel, and a first attachment mechanism, and a second section comprising a second tab, a second c-channel, and a second attachment mechanism, wherein the first attachment mechanism and the second mechanism are cooperatively operable to attach the first section to the second section, wherein the first c-channel and the second c-channel form a channel for housing the cable, wherein the first tab is installable into a first recession of a housing affixed to the device and the second tab is installable into a second recession of the housing, and thereafter the first tab and the second tab are moveable within a channel of the housing until first tab enters a first ridge of the channel and the second tab enters a second ridge of the channel.

17. The shroud of claim 12, wherein the first attachment mechanism comprises a plurality of grips, wherein the second attachment mechanism comprises a plurality, of holes corresponding to the plurality of grips, and wherein each grip of the plurality of grips is insertable into a corresponding hole of the plurality of holes, to effectively attach the first section to the second section.

* * * * *